US011137151B2

(12) United States Patent
Yu et al.

(10) Patent No.: US 11,137,151 B2
(45) Date of Patent: Oct. 5, 2021

(54) EMBEDDED TYPE AIR CONDITIONER OUTDOOR UNIT AND AN AIR CONDITIONER

(71) Applicant: GREE ELECTRIC APPLIANCES, INC. OF ZHUHAI, Zhuhai (CN)

(72) Inventors: Kai Yu, Zhuhai (CN); Handong Xue, Zhuhai (CN); Caizhou Zeng, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 200 days.

(21) Appl. No.: 16/119,784

(22) Filed: Aug. 31, 2018

(65) Prior Publication Data

US 2020/0072480 A1 Mar. 5, 2020

(51) Int. Cl.
*F24F 1/48* (2011.01)
*F24F 1/38* (2011.01)

(52) U.S. Cl.
CPC . *F24F 1/48* (2013.01); *F24F 1/38* (2013.01)

(58) Field of Classification Search
CPC ..... F24F 1/48; F24F 1/38; F24F 1/10; F24F 13/30; F24F 1/0047
See application file for complete search history.

(56) References Cited

U.S. PATENT DOCUMENTS 3,308,634 A * 3/1967 Smith ..... F24F 13/20 62/263
5,657,641 A * 8/1997 Cunningham ..... H05K 7/20536 361/691
7,191,616 B2 * 3/2007 Kim ..... F24F 1/46 62/508
8,127,566 B2 * 3/2012 Hammond ..... F25B 30/02 62/260
2009/0193831 A1 * 8/2009 Kim ..... F04D 29/667 62/259.1
2015/0330403 A1 * 11/2015 Yamasaki ..... F04D 17/08 415/177
2020/0033012 A1 * 1/2020 Nagashima ..... F24F 1/10
2020/0103152 A1 * 4/2020 Mackey ..... F25B 49/027

* cited by examiner

*Primary Examiner* — Gordon A Jones
(74) *Attorney, Agent, or Firm* — Oblon, McClelland, Maier & Neustadt, L.L.P.

(57) ABSTRACT

The present disclosure relates to an embedded type air conditioner outdoor unit and an air conditioner. The embedded type air conditioner outdoor unit comprises: a housing comprising an air inlet and an air outlet which are provided on the same side surface of the housing; a heat exchanger provided within the housing, for heat exchange with air introduced by the air inlet; and a cross-flow fan provided within the housing, for flowing the air introduced by the air inlet through the heat exchanger. By applying the technical solution of the present application, the air introduced by the air inlet after heat exchange by the heat exchanger is expelled via an exhaust port by using the cross-flow fan, thereby improving the problem of much noise of the embedded type air conditioner outdoor unit.

8 Claims, 4 Drawing Sheets

EMBEDDED TYPE AIR CONDITIONER OUTDOOR UNIT AND AN AIR CONDITIONER

FIELD OF THE INVENTION

The present disclosure relates to the field of a refrigeration device, and specifically, relates to an embedded type air conditioner outdoor unit and an air conditioner.

BACKGROUND OF THE INVENTION

At present, the embedded air conditioner is mostly household integrated machine, in which the compressor and the fan are both noise sources, and the fan of the above-mentioned embedded air conditioner is an axial-flow fan, which has the characteristics of much noise and an incompact space structure.

SUMMARY OF THE INVENTION

The present disclosure aims to provide an embedded type air conditioner outdoor unit to improve the problem of much noise of an air conditioner present in the related art.

According to one aspect of an embodiment of the present disclosure, the present disclosure provides an embedded type air conditioner outdoor unit, the embedded type air conditioner outdoor unit comprising: a housing having an air inlet and an air outlet which are provided on a side surface of the housing; a heat exchanger provided within the housing, for heat exchange with air introduced by the air inlet; and a cross-flow fan provided within the housing, for flowing the air introduced by the air inlet through the heat exchanger.

Alternatively, the heat exchanger includes: a first heat exchanger body; and a second heat exchanger body, arranged in a V shape with the first heat exchanger body, the first and second heat exchanger bodies are located between the air inlet and the air outlet, wherein opening end of the V shape is opposite to the side surface provided with the air inlet and the air outlet.

Alternatively, the cross-flow fan is disposed on one side of the second heat exchanger body adjacent to the air outlet.

Alternatively, the air outlet comprises: a first air outlet opening provided on one side of the air inlet; and a second air outlet opening provided on the other side of the air inlet.

Alternatively, the heat exchanger comprises: a first heat exchanger body; and a second heat exchanger body, arranged in a V shape with the first heat exchanger body, he first and second heat exchanger bodies are located between the first air inlet and the second air outlet opening, wherein the opening end of the V shape faces towards the air inlet.

Alternatively, the cross-flow fan comprises: a first cross-flow impeller provided on one side of the first heat exchanger body adjacent to the first air outlet opening; and a second cross-flow impeller provided on one side of the second heat exchanger body adjacent to the second air outlet opening.

Alternatively, at least part of the side wall of the housing is sealed.

According to another aspect of the present application, there is also provided an air conditioner comprising the embedded air conditioner.

Alternatively, the air conditioner further comprises a plurality of air conditioner indoor units, each of which communicates with the embedded type air conditioner outdoor unit.

By applying the technical solution of the present application, the air introduced by the air inlet after heat exchange by the heat exchanger is expelled via an exhaust port by using the cross-flow fan, thereby improving the problem of much noise of the embedded type air conditioner outdoor unit.

Other features of the present disclosure and advantages thereof will become explicit by means of the following detailed descriptions of the exemplary embodiments of the present disclosure with reference to the accompanying drawings.

BRIEF DESCRIPTION OF THE ACCOMPANYING DRAWINGS

The aforementioned as well as other objects, features and advantages of the present disclosure will be more clear, by means of the following descriptions of the embodiments of the present disclosure with reference to the drawings, in which drawings.

1. housing; 2. air inlet; 3. air outlet; 31. first air outlet opening; 32. second air outlet opening; 4. heat exchanger; 41. first heat exchanger body; 42. second heat exchanger body 5. cross-flow fan; 6. volute; 7. compressor; 8. motor.

DETAILED DESCRIPTION OF THE PREFERRED EMBODIMENTS

The present disclosure is described as follows on the basis of the embodiments, but the present disclosure is not only limited to such embodiments. Several specific detailed portions are described in detail in the following detailed descriptions of the present disclosure. For a person skilled in the art, the present disclosure may also be fully understood without descriptions of such detailed portions. In order to avoid confusion of the essence of the present disclosure, detailed narrations are not made to the commonly known methods, processes, flow procedures, and elements.

Embodiment I

Figure 1:
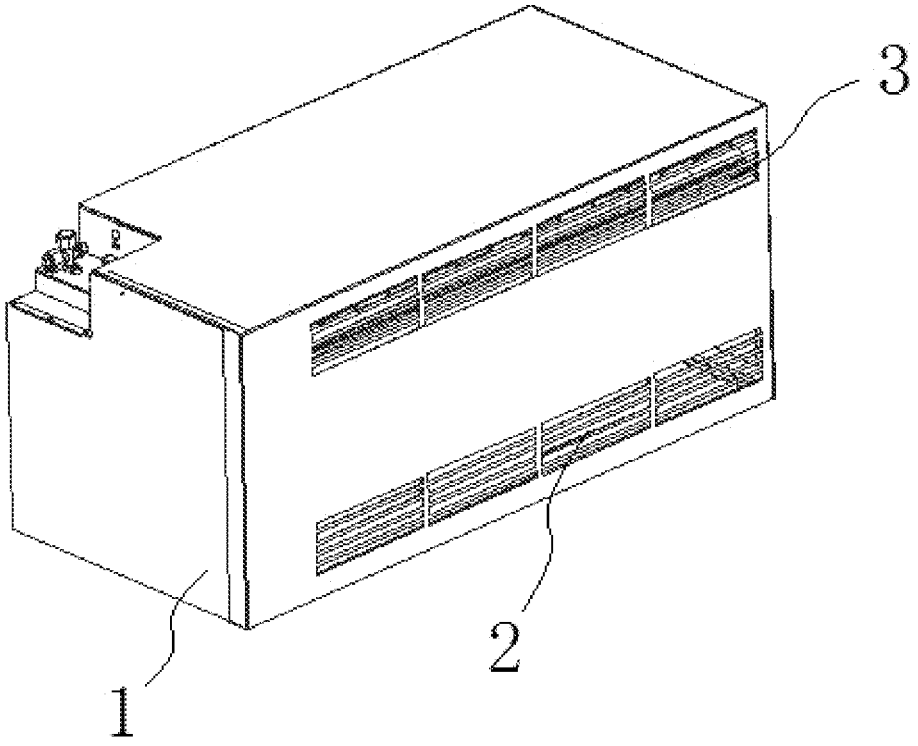
FIG. 1 shows a perspective schematic structural view of the embedded type air conditioner outdoor unit according to the first embodiment of the present disclosure.
Figure 2:
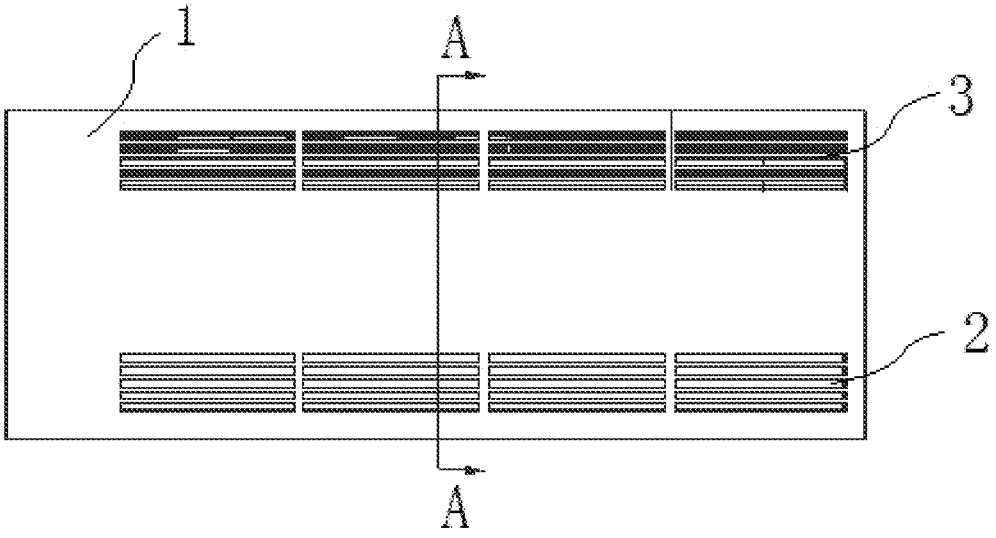
FIG. 2 shows a schematic structural view of the embedded type air conditioner outdoor unit according to the first embodiment of the present disclosure.

FIG. 1 shows a perspective schematic structural view of the embedded type air conditioner outdoor unit according to the present embodiment; FIG. 2 shows a schematic structural view of the air conditioner outdoor unit according to the present embodiment; and FIG. 3 shows a cross-sectional view at A-A in FIG. 2.

Figure 3:
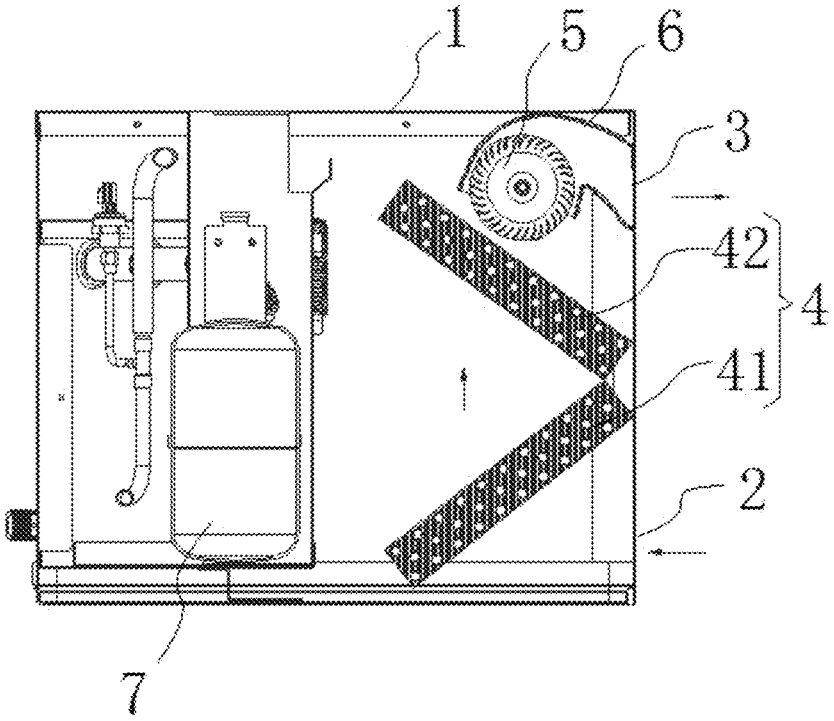
FIG. 3 shows a cross-sectional view at A-A in FIG. 2.

In combination with the illustrations of FIGS. 1 to 3, the embedded type air conditioner outdoor unit of the present embodiment comprises a housing 1, a heat exchanger 4 provided within the housing 4, and a cross-flow fan 5. The housing 1 is provided with an air inlet 2 for introducing air which exchanges heat with the heat exchanger 4, and an air outlet 3 for expelling the air which has exchanged heat with the heat exchanger 4.

The air outlet 3 and the air inlet 2 are disposed on the same side surface of the housing 1, and after the embedded type air conditioner outdoor unit is embedded in the wall of the building, the side surface provided with the air outlet 3 and the air inlet 2 faces toward the outside of the building, so as to facilitate that the air inlet 2 introduces the air and the air outlet 3 expels the air after the heat exchange. The cross-flow fan 5 is used to introduce air by the air inlet 2 and expel the air which has exchanged heat with the heat exchanger 4 by the air outlet 3.

Relative to the technical solution that the air conditioner outdoor unit is suspended from the outer wall of the building in the related art, the embedded type air conditioner outdoor unit can prevent accidental damage and accidental loss caused by accidental fall-off.

After the embedded type air conditioner outdoor unit is embedded in the building, the vibration of the embedded outdoor unit is easily transferred to the indoor. The embedded outdoor unit of this embodiment adopts a cross-flow fan 5 with less noise and vibration to reduce the noise produced in the operation process of the embedded outdoor unit.

At least part of the side wall of the housing is sealed. The four vertical side walls of the housing are connected and sealed to reduce the noise and vibration propagated by the embedded air conditioner to the outside.

The embedded outdoor unit further comprises a compressor 7 mounted within the housing 1. When the air conditioner is in the cooling operation condition, the refrigerant compressed by the compressor 7 is conveyed to the heat exchanger 4 for heat radiation, and the refrigerant after heat radiation enters the indoor heat exchanger after throttling, the refrigerant is evaporated in the indoor heat exchanger to absorb the indoor heat, so as to reduce the indoor temperature.

In this embodiment, the air outlet 3 is located at the upper portion of the housing 1, and the air inlet 2 is located at the lower portion of the housing 1. Since the air with a higher temperature has a lower density, the provision of the air outlet 3 above the air inlet 2 facilitates the air flow.

In this embodiment, the heat exchanger 4 includes a first heat exchanger body 41 and a second heat exchanger body 42 arranged in a V shape with respect to the first heat exchanger body 41. The first heat exchanger body 41 and the second heat exchanger body 42 are both located between the air inlet 2 and the air outlet 3, and the V-shaped opening opposite to the side surface of the air inlet 2 and the air outlet 3.

The air introduced by the air inlet 2 flows toward the air outlet 3 along a substantially arc-shaped path, and the first heat exchanger body 41 and the second heat exchanger body 42 are arranged in a V shape, which is favorable for allowing that the first heat exchanger body 41 and the second heat exchanger body 42 are both substantially perpendicular to the path of the air flow, and thus increases a contact area of the air with the first heat exchanger body 41 and the second heat exchanger body 42.

Further, the first heat exchanger body 41 and the second heat exchanger body 42 are arranged in a V-shape, which is also favorable for making full use of the space within the housing 1 to make the structure of the embedded outdoor unit more compact.

The cross-flow fan 5 is disposed on a side of the second heat exchanger body 42 adjacent to the air outlet 3, and the embedded type air conditioner outdoor unit further comprises a volute 6 for guiding the airflow of the cross-flow fan 5 toward the air outlet. The cross-flow fan 5 is mount on a side of the second heat exchanger body 42 adjacent to the air outlet 3, and can also function to make full use of the space within the housing 1.

Figure 4:
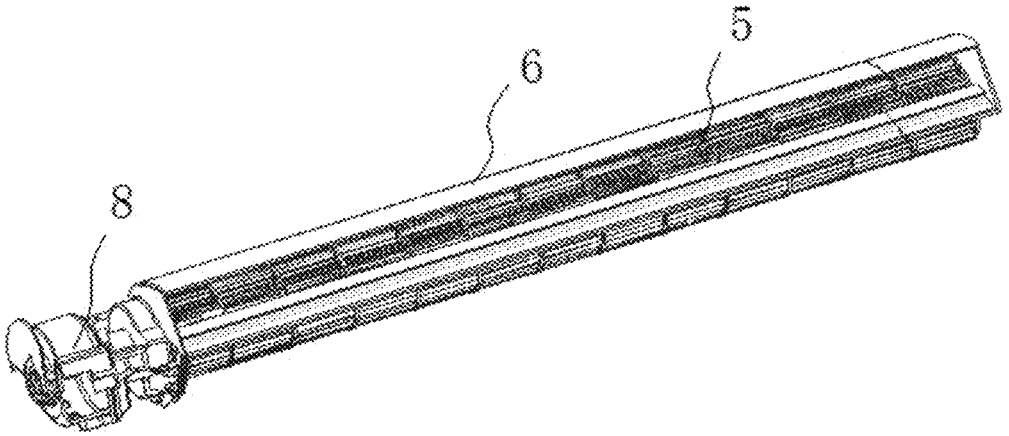
FIG. 4 shows a schematic structural view of an fan assembly of the embedded type air conditioner outdoor unit according to the first embodiment of the present disclosure.

FIG. 4 shows a perspective schematic structural view of an fan assembly of the embedded type air conditioner outdoor unit. The fan assembly includes a cross-flow fan 5, a volute 6 and a motor 8 that drives the cross-flow fan 5 to rotate.

Figure 5:
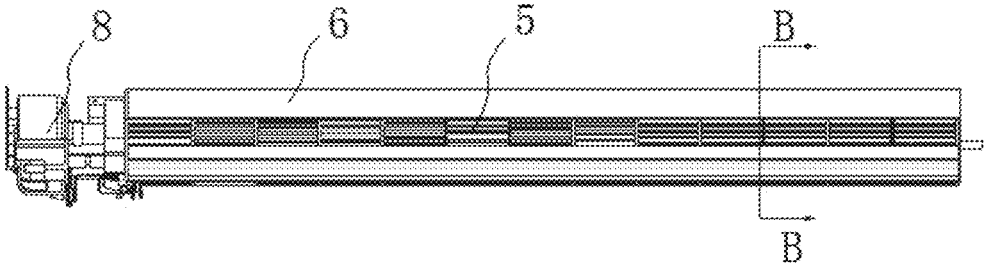
FIG. 5 shows a schematic structural view of an fan assembly of the embedded type air conditioner outdoor unit according to the first embodiment of the present disclosure.
Figure 6:
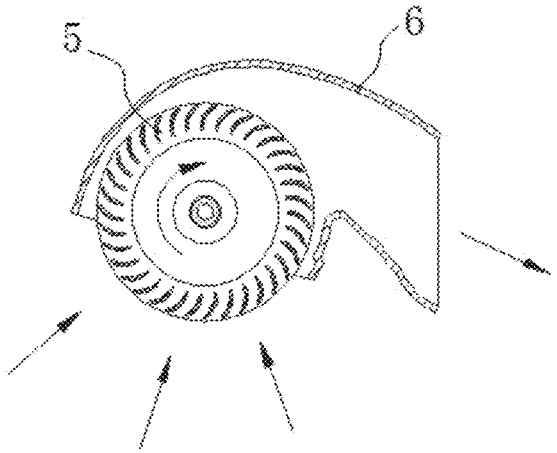
FIG. 6 shows a cross-sectional view at B-B in FIG. 5.

FIG. 5 shows a schematic structural view of an fan assembly according to the present embodiment. FIG. 6 shows a cross-sectional view at B-B in FIG. 5.

Figure 7:
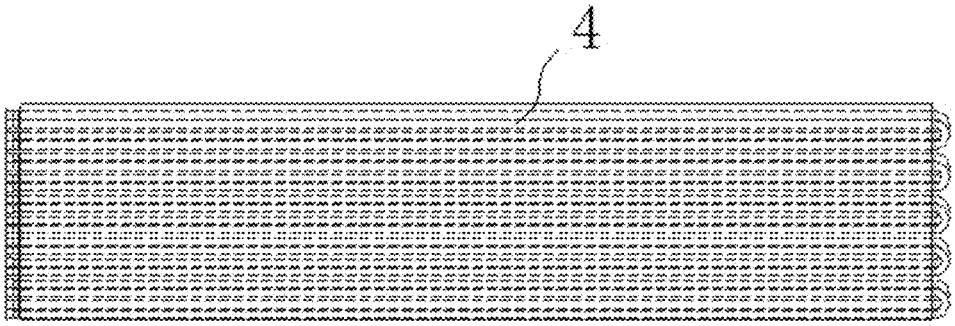
FIG. 7 shows a schematic structural view of a heat exchanger of the embedded type air conditioner outdoor unit according to the first embodiment of the present disclosure.

FIG. 7 shows a schematic structural view of a heat exchanger 4 of the embedded type air conditioner outdoor unit according to the present embodiment. The two heat exchangers 4 are arranged obliquely with respect to each other so as to constitute the V-shaped arrangement described above such that the two heat exchangers 4 are arranged obliquely with respect to each other.

According to another aspect of the present application, the present embodiment further discloses an air conditioner, which is a VRF (Variable refrigerant Volume) air conditioner. The air conditioner comprises a plurality of indoor units and the aforementioned embedded type air conditioner outdoor unit, in which the plurality of indoor units communicate with the aforementioned embedded type air conditioner outdoor unit to allow the embedded type air conditioner outdoor unit to supply a refrigerant to the aforementioned plurality of indoor units.

Embodiment II

Figure 8:
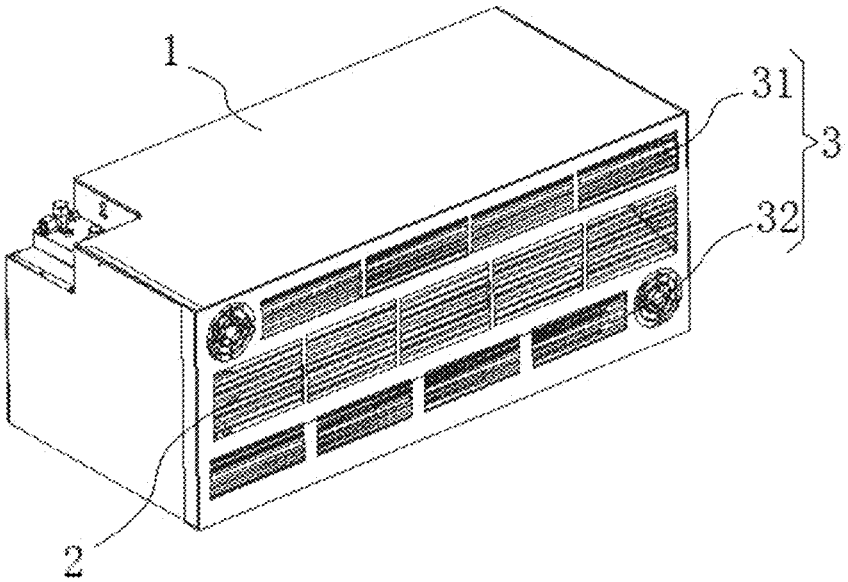
FIG. 8 shows a perspective schematic structural view of the embedded type air conditioner outdoor unit according to the second embodiment of the present disclosure.
Figure 9:
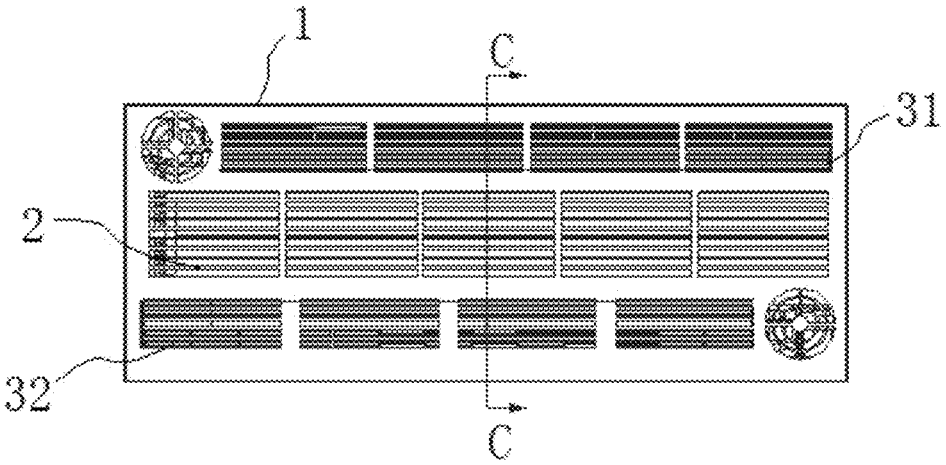
FIG. 9 shows a schematic structural view of the embedded type air conditioner outdoor unit according to the second embodiment of the present disclosure.
Figure 10:
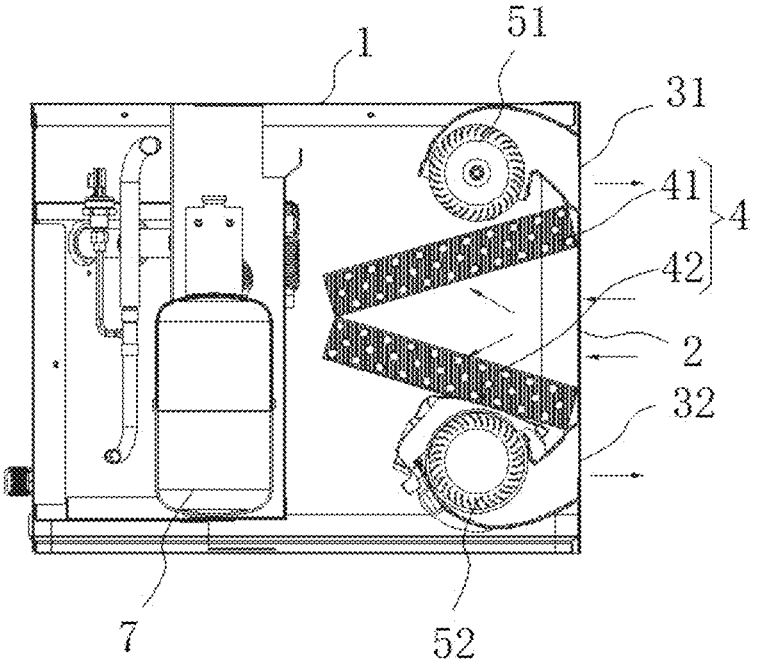
FIG. 10 shows a cross-sectional view at C-C in FIG. 9.

FIG. 8 shows a perspective schematic structural view of the embedded type air conditioner outdoor unit according to the present embodiment; FIG. 9 shows a schematic structural view of the embedded type air conditioner outdoor unit according to the present embodiment; and FIG. 10 shows a cross-sectional view at C-C in FIG. 9.

The difference between this embodiment and the embodiment I lies in that: the air outlet 3 includes a first air outlet opening 31 provided on one side of the air inlet 2 and a second air outlet opening 32 provided on the other side of the air inlet 2.

The heat exchanger 4 includes a first heat exchanger body 41 and a second heat exchanger body 42 arranged in a V shape with respect to the first heat exchanger body 41. The second heat exchanger body 42 and the first heat exchanger body 41 are both located between the first air outlet opening 31 and the second air outlet opening 32, and the V-shaped opening faces towards the air inlet 2.

The air introduced by the air inlet 2 flows between the first heat exchanger body 41 and the second heat exchanger body 42 via the aforementioned V-shaped opening, and then flows to the first heat exchanger body 41 and the second heat exchanger body 42 respectively. After that, the air is expelled via the first air outlet opening 31 and the second air outlet opening 32 respectively.

The cross-flow fan includes a first cross-flow impeller 51 provided on a side of the first heat exchanger body 41 adjacent to the first air outlet opening 31, and the first cross-flow impeller 51 is used to expel via the first air outlet opening 31 the air introduced by the air inlet 2 after flowing through the first heat exchanger body 41.

The cross-flow fan includes a second cross-flow impeller 52 provided on a side of the second heat exchanger body 42 adjacent to the second air outlet opening 32, and the second cross-flow impeller 52 is used to expel via the second air outlet opening 32 the air introduced by the air inlet 2 after flowing through the second heat exchanger body 42.

The foregoing is intended only as a preferred embodiment of the present disclosure, but is not used for limiting the present disclosure, and for a person skilled in the art, the present disclosure may have various modifications and variations. Any amendment, equivalent replacement, improvement, and the like within the spirit and principles of the present disclosure should all be contained within the protection scope of the present disclosure.

The invention claimed is:

1. An embedded type air conditioner outdoor unit, configured to be embedded within a wall of a building, the embedded type air conditioner outdoor unit comprising:

a housing having an air inlet and an air outlet which are provided on a same side wall the housing;

a heat exchanger provided within the housing, for heat exchange with air introduced by the air inlet; and a cross-flow fan provided within the housing for flowing the air introduced by the air inlet through the heat exchanger, wherein the heat exchanger includes:

a first heat exchanger body, and a second heat exchanger body arranged in a V shape with the first heat exchanger body, the first and second heat exchanger bodies are located between the air inlet and the air outlet, and wherein an entire opening end of the V shape is to further away from the side provided with the air inlet and the air outlet, of the housing than a tip of the V shape.

2. The embedded type air conditioner outdoor unit according to claim 1, wherein, the cross-flow fan is disposed on one side of the second heat exchanger body adjacent to the air outlet.

3. The embedded type air conditioner outdoor unit according to claim 1, wherein the air outlet comprises:

a first outlet opening provided on one side of the air inlet; and a second air outlet opening provided on the other side of the air inlet.

4. The embedded type air conditioner outdoor unit according to claim 3, wherein the cess-ow fan comprises:

a first cross-flow impeller provided on one side of the first heat exchanger body adjacent to the first air outlet opening; and a second cross-flow impeller provided on one side of the second heat exchanger body adjacent to the second air outlet opening.

5. The embedded type air conditioner outdoor unit according to claim 1, wherein at least one side wall of the housing is sealed.

6. An air conditioner, comprising an embedded type air conditioner outdoor unit configured to be embedded within a wall of a building, the embedded type air conditioner outdoor unit including:

a housing having an air inlet and an air outlet which are provided on a same side wall the housing;

a heat exchanger provided within the housing, for heat exchange with air introduced by the air inlet; and a cross-flow fan provided within the housing for flowing the air introduced by the air inlet through the heat exchanger, wherein the heat exchanger includes:

a first heat exchanger body; and a second heat exchanger body arranged in a V Shape with the first heat exchanger body, the first and second heat exchanger bodies are located between the air inlet and the air outlet, and wherein an entire opening end of the V shape is opposite to further away from the side wall, provided with the air inlet and the air outlet, of the housing than a tip of the V shape.

7. The air conditioner according to claim 6, further comprising a plurality of air conditioner indoor units, each of the air conditioner indoor units communicates with the embedded type air conditioner outdoor unit.

8. The embedded type air conditioner outdoor unit according to claim 1, Wherein the entire opening end is a space between a distal end of the first heat exchanger body and a distal end of the second heat exchanger body forming the V shape.

* * * * *